US005364137A

United States Patent [19]

Shimer

[11] Patent Number: 5,364,137

[45] Date of Patent: Nov. 15, 1994

[54] INFANT HIGHCHAIR

[75] Inventor: Christine R. Shimer, Mahwah, N.J.

[73] Assignee: Safe-Strap Company, Inc., Old Tappan, N.J.

[21] Appl. No.: 42,543

[22] Filed: Apr. 5, 1993

[51] Int. Cl.[5] ..... A47D 1/00; A47D 1/06

[52] U.S. Cl. ..... 297/327; 297/130; 297/326

[58] Field of Search ..... 297/327, 326, 130, 440, 297/183

[56] References Cited

U.S. PATENT DOCUMENTS

| | | | |
|---|---|---|---|
| D. 188,844 | 9/1960 | Scheffey . | |
| D. 189,664 | 1/1961 | Fulton . | |
| D. 192,731 | 5/1962 | Gelman . | |
| D. 208,152 | 7/1967 | Levy et al. . | |
| D. 237,023 | 10/1975 | Rossi . | |
| D. 246,553 | 12/1977 | Ballenger . | |
| 1,330,373 | 2/1920 | Hall | 297/183 X |
| 2,587,881 | 3/1952 | Oakes | 297/327 |
| 2,889,152 | 6/1959 | Hurst et al. | 297/327 X |
| 2,968,338 | 1/1961 | Reese | 297/134 |
| 3,134,627 | 5/1964 | Mason | 297/440 X |
| 3,345,105 | 10/1967 | Levy | 297/149 X |
| 3,649,074 | 3/1972 | McDonald | 297/130 X |
| 4,065,175 | 12/1977 | Perego | 297/130 |
| 4,082,349 | 4/1978 | Ballenger | 297/183 |
| 4,231,612 | 11/1980 | Meeker | 297/327 X |
| 4,516,806 | 5/1985 | McDonald | 297/183 X |
| 4,634,177 | 1/1987 | Meeker | 297/440 X |
| 4,697,845 | 10/1987 | Kamman | 297/118 |
| 4,832,354 | 6/1988 | LaFreniere | 297/130 X |
| 5,028,061 | 7/1991 | Hawkes | 297/327 X |
| 5,052,749 | 10/1991 | Groenendijk . | |
| 5,188,380 | 2/1993 | Tucek | 297/183 X |

FOREIGN PATENT DOCUMENTS

| | | | |
|---|---|---|---|
| 1039393 | 5/1953 | France | 297/327 |
| 566799 | 9/1957 | Italy | 297/134 |
| 2149653 | 6/1985 | United Kingdom | 297/183 |

*Primary Examiner*—Brian K. Green
*Assistant Examiner*—David E. Allred
*Attorney, Agent, or Firm*—Ostrolenk, Faber, Gerb & Soffen

[57] ABSTRACT

An infant highchair including a support structure having four legs, respective pairs of the legs each forming an inverted generally U-shaped member, the U-shaped members having an apex region, a molded plastic infant seat, a pair of hubs, each coupled to a side of the infant seat, the hubs each enclosing a mechanism for pivotally attaching the infant seat to the apex region of respective ones of the U-shaped members, the pivoting mechanism defining at least two positions of the infant seat, the positions including an upright position and a reclined position and a locking device being provided for locking the infant seat in each of the positions.

37 Claims, 3 Drawing Sheets

FIG. 1
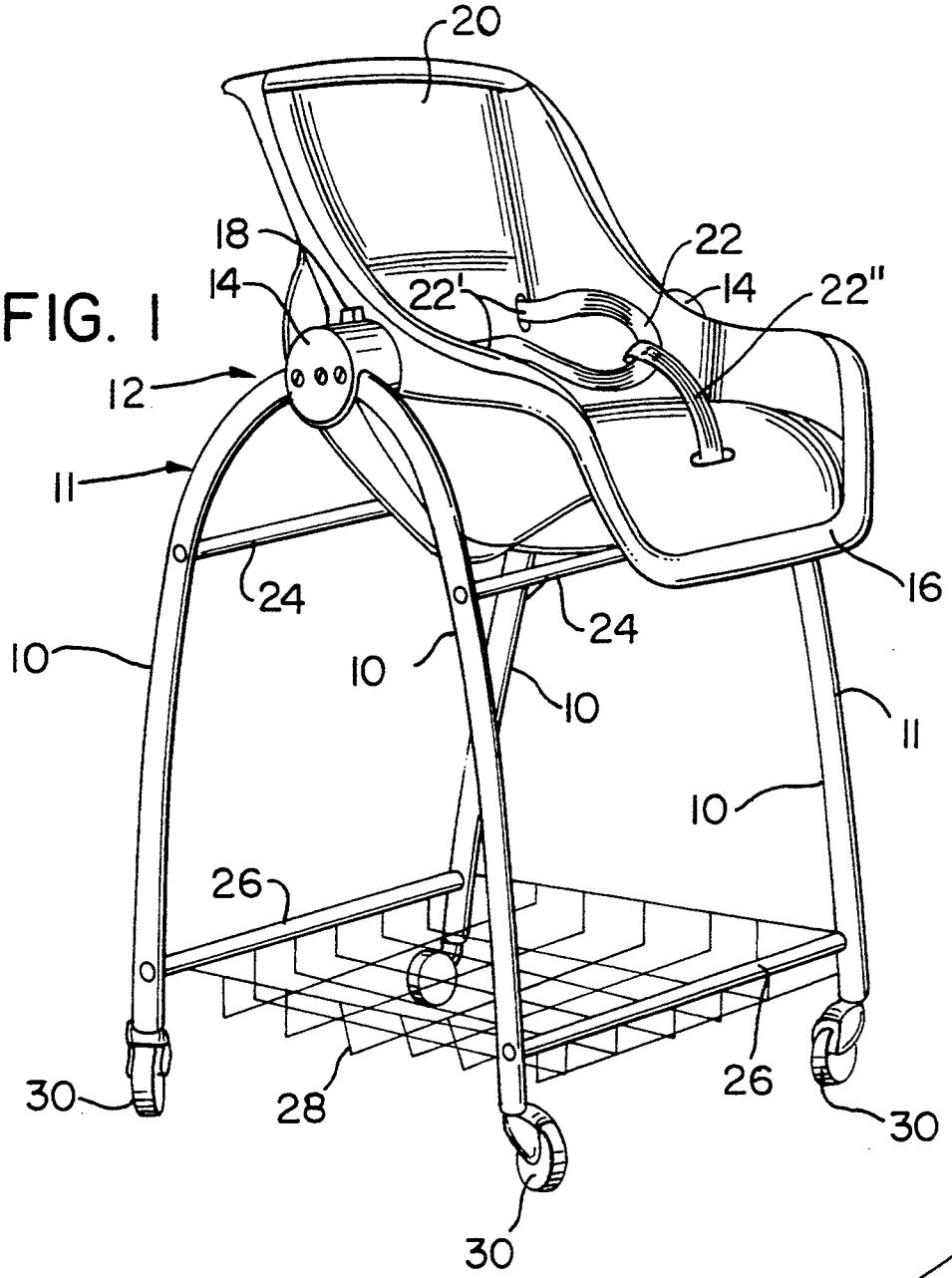
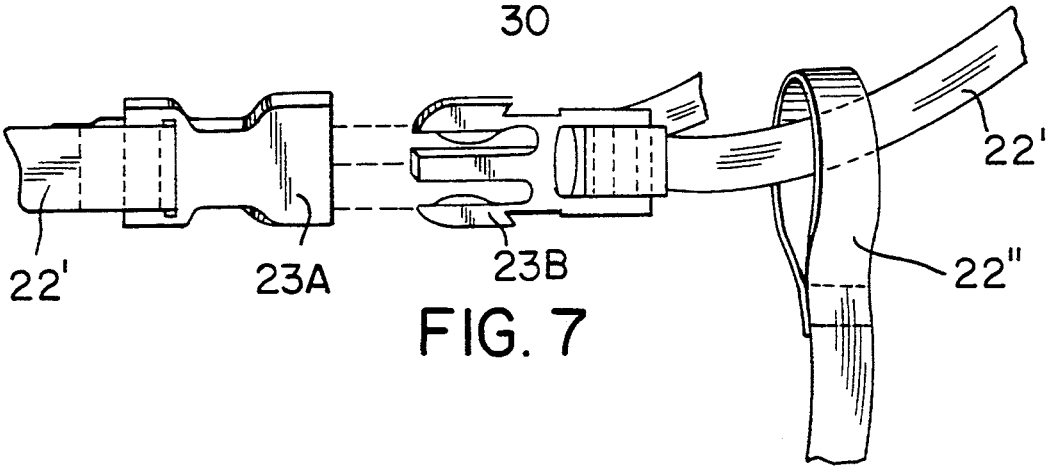
FIG. 7

FIG. 2
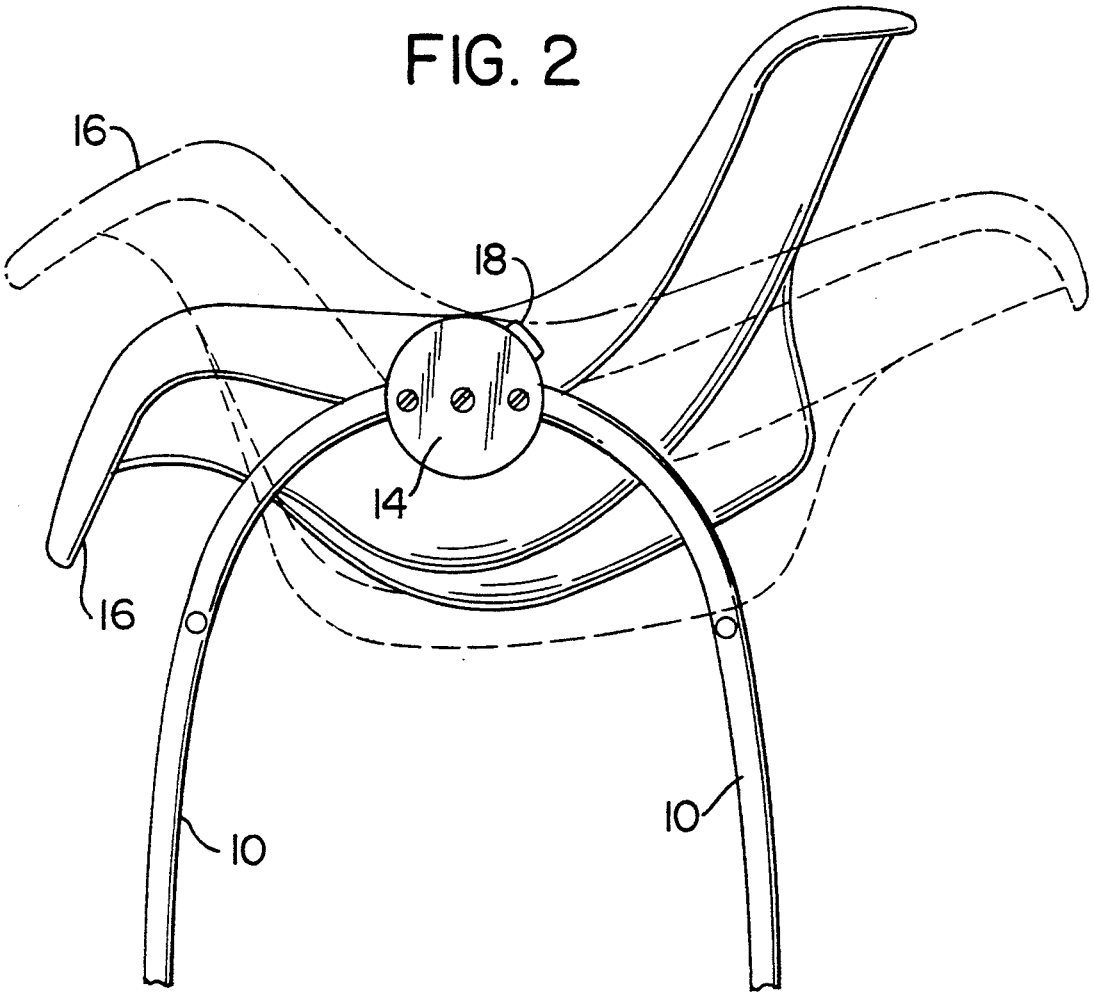
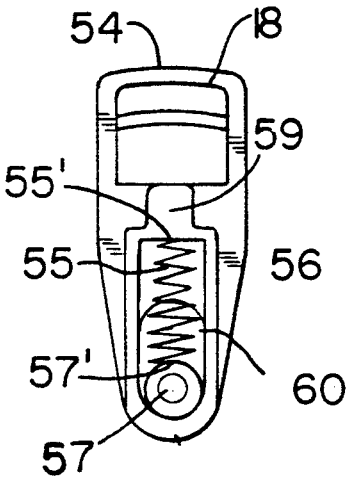
FIG. 5
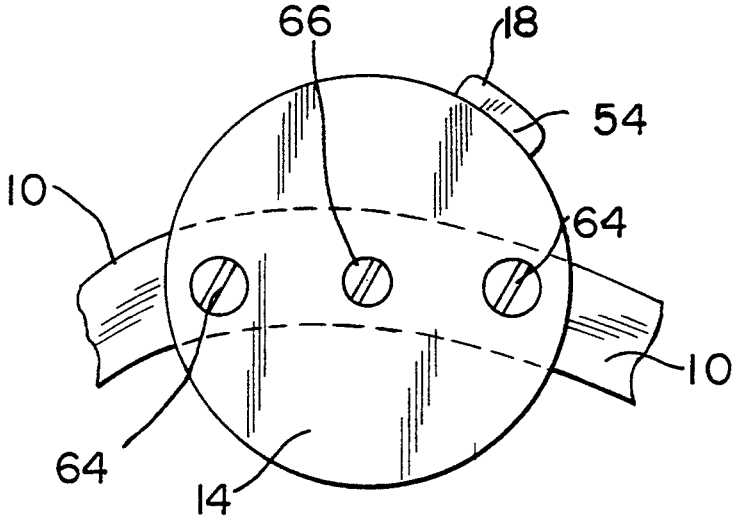
FIG. 6

INFANT HIGHCHAIR

BACKGROUND OF THE INVENTION

The present invention relates to a highchair for infants, that is, a highchair for young children who do not yet possess the skills to sit up such as a toddler. Thus, the present invention is directed to highchairs for children who are not yet toddlers.

Various highchairs are known. For example, U.S. Pat. Nos. 3,649,074 and U.S. Design Pat. Nos. 208,152, 188,844, 192,731 and 237,023 disclose various forms of highchairs. However, each of these highchair is not suitable for use by infants, i.e., those children who are not yet toddlers and who cannot yet sit up.

Various forms of infant and baby seats are known, for example, U.S. Pat. Nos. 5,052,749 and 4,231,612. These devices, however, although suitable for use as carriers or car seats for infants, are not suitable for use as infant highchairs.

SUMMARY OF THE INVENTION

It is, accordingly, an object of the present invention to provide an infant highchair.

It is yet still a further object of the present invention to provide a highchair which is suitable for use by infants, i.e., those children below the age at which they possess the skills to sit up, i.e., below the age at which they become toddlers.

It is yet still a further object of the present invention to provide a highchair for infants below approximately 20 lbs.

It is yet still a further object of the present invention to provide an infant highchair which is easy to use, adjustable, convenient to move around, and which is easy to keep clean.

It is yet still a further object of the present invention to provide an infant highchair which provides a plurality of positions of the infant seat, i.e., an upright position and an inclined position, which will facilitate, for example, feeding the infant and resting of the infant.

It is yet still a further object of the present invention to provide an infant highchair which is easy to construct, strong, and which is safe and stable.

It is yet still a further object of the present invention to provide an infant highchair which provides a shelf for storage space.

The above and other objects of the present invention are achieved by an infant highchair comprising a support structure having four legs, respective pairs of said legs forming two inverted generally U-shaped members, the U-shaped members each having an apex region, and further comprising a molded plastic infant seat, a pair of hubs, each hub coupled to a side of said infant seat, said hubs each enclosing means for pivotally attaching said infant seat to the apex region of respective ones of said U-shaped members, said means for pivotally attaching defining at least two positions of said infant seat, said positions including an upright position and a reclined position and means for locking said infant seat in each of said positions.

The above and other objects are furthermore achieved by an infant highchair comprising a support structure having four legs, respective pairs of said legs being connected together by top portions, a molded plastic infant seat a pair of pivots, each pivot coupled to a side of said infant seat, the pivots attaching said infant seat to the top portions of respective pairs of said legs, said pivots defining at least two positions of said infant seat, said positions including an upright position and a reclined position and means for locking said infant seat in each of said positions.

Other features and advantages of the present invention will become apparent from the following description of the invention which refers to the accompanying drawings.

BRIEF DESCRIPTION OF THE DRAWINGS

The invention will now be described in greater detail in the following detailed description with reference to the drawings in which:

FIG. 1 shows the infant highchair according to the present invention in perspective view;

FIG. 2 shows the infant highchair according to the present invention in two positions, an upright position and a reclined position, the reclined position being indicated in phantom;

FIG. 5 shows a component of the pivoting and locking mechanism of FIG. 3 according to line 5—5 of FIG. 3;

FIG. 6 shows how the hub enclosing the pivoting and locking mechanism attaches to the apexes of the support structure; and FIG. 7 shows the seat belt of the infant seat.

DETAILED DESCRIPTION OF THE INVENTION

Figure 3:
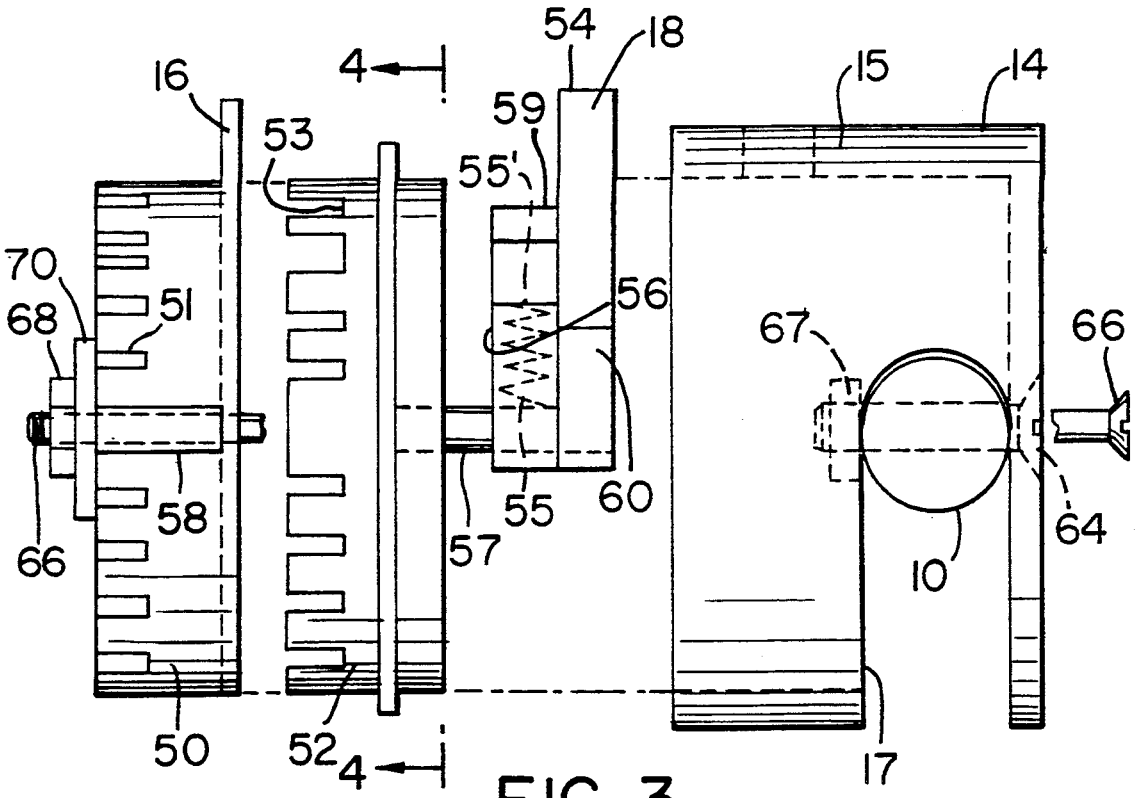
FIG. 3 shows the pivoting and locking mechanism of the infant highchair according to the present invention in a cross sectional exploded view.

With reference now to the drawings, FIG. 1 shows the infant highchair according to the present invention in perspective view. As shown, the infant highchair includes four legs 10, respective pairs of which are formed into inverted generally U-shaped support members 11. The U-shaped members can be made from either round or square tubing in cross section. Additionally, the U-shaped members can have rounded apex regions as shown, or they can be squared-off at the top, i.e., the legs 10 can be joined at approximately right angles to a horizontal top bar to form the U-shaped member. At the apex 12 of each of the U-shaped support members 11, a hub 14 is arranged. Each hub 14 contains a pivoting and locking mechanism, to be described in greater detail with reference to FIGS. 3–6. Each pivoting and locking mechanism contained within the hub 14 is secured to a respective side of a molded infant seat 16. The pivoting and locking mechanism in each hub includes a push button 18, shown in more detail in FIGS. 3–6, which, when depressed, releases the molded infant seat for pivotal movement. Preferably, the infant seat has two positions, an upright position and an inclined position, as shown in FIG. 2. The upright position can facilitate, for example, feeding, whereas the inclined position allows the infant to rest.

The infant seat itself may be a conventionally available infant seat type No. BC-237WH, available from Century Products, Inc., 1366 Commerce Drive, Stow, Ohio 44224.

Preferably, the infant seat 16 includes, for comfort, a padding 20, for example, a vinyl padding, to facilitate cleaning. The infant seat 16 is furthermore provided with a seat belt 22, for example, a waist and crotch belt, which is secured through openings in padding 20 to securement positions provided in the molded plastic seat. Preferably, the waist belt portions 22' have mating plastic snap connections 23A and 23B for quick assembly and disassembly. The crotch portion 22'' is provided with a looped end which receives one of the ends of the waist portions 22'. This is shown in detail in FIG. 7.

Preferably, the infant highchair includes two pairs of horizontal bars tying the two U-shaped support members 11 together. One of the pairs of horizontal bars 24 is provided near the top of the inverted U-shaped support members, and generally provides stops for limiting absolute forward and rearward pivotal movement of the infant seat, in addition to increasing structural rigidity. Another pair of horizontal bars 26 is provided near the bottom of the U-shaped support members 11 to provide further rigidity, and also, as disclosed in the preferred embodiment, as a support surface supporting a preferably removable shelf 28. The shelf 28 may be a gridded structure, as shown, and is used to stow articles, for example, an infant's diaper bag or any other articles.

At the foot of each leg 10, according to the preferred embodiment, a castered wheel 30 is provided, facilitating movement of the infant highchair. The casters may be provided with suitable caster brakes to prevent movement of the highchair, as desired.

The invention provides a convenient infant highchair which allows infants not yet toddlers to be seated at the table with other members of the family, for example, at the dinner table or at restaurants.

The arrangement of the invention provides a very stable and safe structure. The U-shaped support members 11, coupled together by the horizontal bars 24 and 26 and the infant seat itself at the hubs 14, provide an inherently stable structure which is not easily overturned. The pivoting and locking mechanisms contained within the hubs 14, as shown in more detail in FIGS. 3–6, allow the infant seat to be pivoted to different positions, something which is especially important in the care of infants.

FIG. 2 shows the infant highchair according to the present invention in its two pivoting positions, The position shown in black lines is the upright position, for example, suitable for feeding, and the position shown in phantom is the reclined position.

FIGS. 3 through 6 show details of the pivoting and locking mechanism. With the exception of the hub 14, which is especially provided for the infant highchair according to the invention, the remaining elements of the pivoting and locking mechanism are conventionally available on the Century infant seat, identified above.

The pivoting and locking mechanism is provided into a recess 50 which is disposed in the conventionally available seat. The recess 50 is formed integrally in the molded sides of the infant seat 16, and includes an extending boss 58 having a hole therethrough for receiving a screw 66. The recess 50 includes a plurality of radially extending projections 51, which receive mating recesses 53 in a preferably molded plastic member 52, to lock the member 52 securely into the recess 50 of the infant seat 16. A push button lever 18 is provided having an elongated recess 60 through which boss 57 extends. Screw 66 extends through a central hole in hub cover 14, through an apertured boss 57 provided on element 52 and through the hole in boss 58 and holds the entire pivoting and locking mechanism together. A nut 68 can be provided at the end of screw 66. Push button lever 18 includes a finger grip portion 54. The lever 18 is biased upwardly by a coil spring 55 contained in a hollow 56 within the lever 18. The spring 55 is disposed between a top surface 55' of hollow 56 and the top surface 57' of the boss 57. The lever 18 extends through an opening 15 provided in the hub cover 14. As shown in the figures, the hub cover 14 preferably is made of molded plastic and includes an elongated recess 17, which allows the hub cover, assembled to the seat 16, and enclosing the elements 18, 52 and 54, to attach to the U-shaped members comprising the legs 10. Preferably, two holes are provided through the members 11 and the hub member 14, as more clearly shown in FIG. 6, which receive screws 64, thereby fastening the infant seat 16 to the U-shaped members 11. Lock nuts 67 can be provided to hold the hubs securely to the U-shaped members 11. In addition, as described, a screw 66 is received through a third center hole in the hub 14, through a third hole in the U-shaped member 11 and through the bosses 57 and 58. A lock nut 68 and a washer 70 can be provided to hold the internal pivoting and locking mechanism comprised of the elements 50, 52 and 18, contained within the hub cover 14, together.

As shown, when a user depresses the two levers 18, one extending from each of hubs 14, each lever 18 moves downward along the boss 57 guided within the elongated recess 60, compressing the coil springs 55. The lever 18, which may be molded plastic, includes a pawl 59 formed integrally in the lever, which is received in one of two molded openings 59A or 59B contained within the inner circumference of element 52, also preferably molded plastic. FIG. 4 shows element 52 along lines 4—4 of FIG. 3. The lever 18 is shown in phantom in FIG. 4 so that the pawl 59 is contained within an opening 59B, which is one of the two positions of the infant seat. In order to move it to the other position 59A, the finger grips 54 of each lever 18 extending from each hub 14 are depressed, moving the pawl 59 out of the opening 59B, and then the seat 16 is rotated, thereby rotating the recess portion 50 and the member 52, and once the pawl 59 moves into a position so that it is near the recess 59A, the lever 18 is released, allowing the pawl 59 to move into the recess 59A, thereby locking it into the new position. The recesses 59A and 59B, as well as the surfaces of the pawl 59, may be made comfortably rounded so that they will find their positions in the holes 59A and 59B.

In the pivoting and locking mechanism provided on the infant seat 16 available from Century Products, additional positions defined by recesses 59C and 59D may be provided. Since these positions are not useful in the infant highchair according to the invention, a blocking arc-shaped member 62 is provided to block off these openings and to prevent movement into these positions.

Figure 4:
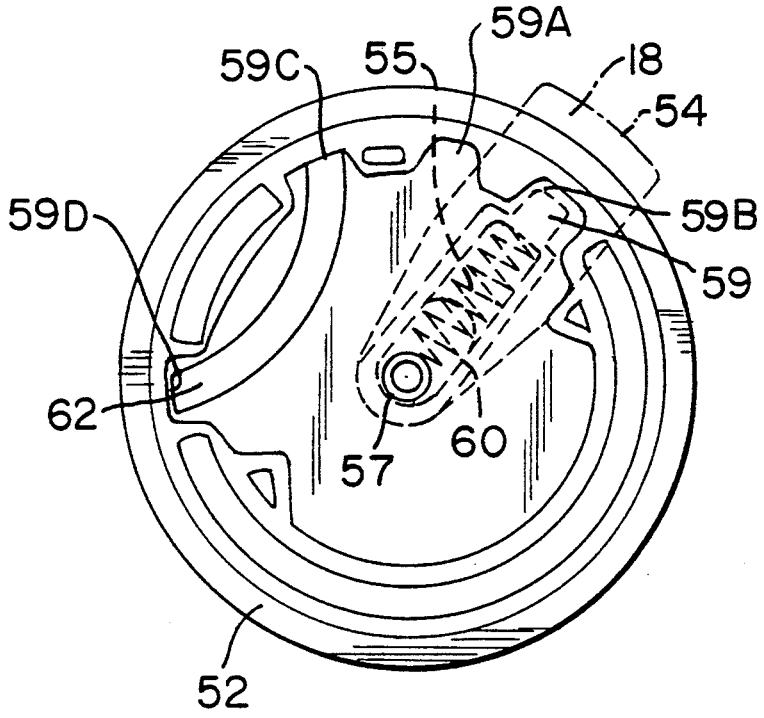
FIG. 4 shows a portion of the pivoting and locking mechanism according to line 4—4 of FIG. 3.

FIG. 5 shows details of the lever arm 18 along the lines 5—5 of FIG. 3, showing the spring 55 contained within recess 56 in the lever arm 18 and biased between the surface 55' of the recess 56 and the surface 57' of the projection 57 molded to the member 52.

FIG. 6 shows the hub 14 assembled to a member 11. The hub 14 is assembled to the member 11 via screws 64, e.g., counter-sunk screws, and nuts 67. Screw 66 holds the hub to the seat 16 and keeps the components of the pivoting and locking mechanism together. Nut 68 and washer 70, located in the interior portion of seat 16, under padding 20, are tightened down on screw 66 to secure the seat 16 to the hub 14 containing the pivoting and locking mechanism.

Although the support structure for the infant highchair comprising the "U" shaped members 11 and the horizontal bars 26 and 24 are shown as being held together by suitable fasteners, for example, screws extending through the legs 10 and received in the ends of the bars 24 and 26, the support structure for the infant highchair according to the invention can also be made as an integrally welded structure or a uniformly molded plastic structure or plastic molded component parts integrated to comprise the support structure.

Additional modifications can also be made to the invention. For example, the casters 30 can be provided with brakes to prevent movement of the infant highchair. The padding 20 can be either a sewn or upholstered-type padding suitably applied to the seat 16, or it can be a molded one-piece soft padding which is shaped to the inner contours of the seat 16.

Another modification might be to releasably attach the infant seat 16 to the apexes of the members 11, instead of the more permanent arrangement shown herein. This would allow the infant seat to be removed from the infant highchair for carrying the infant. Additionally, a suitable handle could be attached to the infant seat 16 for facilitating carrying the infant seat 16. The handle could be made removable or pivotable, if desired. Furthermore, only one locking mechanism in a hub 14 is necessary, although two are provided in the invention for increased safety.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A highchair for supporting an infant who is too young to be able to sit up without support with the infant's back in an erect position comprising:

a support structure having four legs, respective pairs of said legs forming two inverted generally U-shaped members, the U-shaped members each having an apex region;

an infant seat adapted to cradle an infant's body so as to provide support for the infant's back from below and to conform to the contour of the body of an infant who is too young to be able to sit up without support with the infant's back in an erect position, the infant seat having bottom and back portions and having a vertical height measured from a lowest point of the bottom portion to a highest point of the back portion, the support structure having a height which enables the infant to be supported in the infant seat at a height substantially above floor level, said height of the support structure being greater than the vertical height of the infant seat, whereby the infant seat is supported at a height allowing the infant in the infant seat to be drawn up to a dining table at substantially dining table height for feeding;

a pair of hubs, each hub coupled to a side of said infant seat, said hubs each enclosing means for pivotally attaching said infant seat to the apex region of respective ones of said U-shaped members, said means for pivotally attaching defining at least two positions of said infant seat, said positions including an upright position and a reclined position; and means for locking said infant seat in each of said positions.

2. The infant highchair of claim i, wherein the locking means is provided in at least one of said hubs.

3. The infant highchair of claim 2, further comprising a locking means in each of said hubs.

4. The infant highchair of claim 2, wherein a button of the locking means extends through an aperture in a hub, for operation by a user to unlock and lock the infant seat.

5. The infant highchair of claim 1, further comprising a wheel at the bottom of each of said legs.

6. The infant highchair of claim 5, wherein the wheel at the bottom of each of said legs comprises a caster.

7. The infant highchair of claim 1, further comprising a shelf disposed between said U-shaped members near the bottom of said legs.

8. The infant highchair of claim 7, wherein the shelf comprises an open grid structure.

9. The infant highchair of claim 1, further comprising horizontal bars near the bottom of said legs connecting said two U-shaped members together.

10. The infant highchair of claim 9, further comprising a removable shelf disposed between said U-shaped members resting on said horizontal bars.

11. The infant highchair of claim 10, wherein the shelf comprises an open grid structure.

12. The infant highchair of claim 1, further comprising a seat belt for securing an infant in the infant seat.

13. The infant highchair of claim 12, wherein the seat belt comprises a waist and crotch belt.

14. The infant highchair of claim 1, further comprising two horizontal bars connecting said two U-shaped members and located below said infant seat for providing stops limiting forward and rearward pivotal motion of the infant seat.

15. The infant highchair of claim 1, wherein the hubs each include a recess receiving the apex region of a respective one of the U-shaped members.

16. The infant highchair of claim 1, wherein the infant seat comprises molded plastic.

17. The infant highchair of claim 16, further comprising padding for said molded infant seat.

18. The infant highchair of claim 1, further comprising wheel at the bottom of at least two of said legs.

19. A highchair for supporting an infant who is too young to be able to sit up without support with the infant's back in an erect position comprising:

a support structure having four legs, respective ones of said legs being connected together in pairs by top portions;

an infant seat adapted to cradle an infant's body so as to provide support for the infant's back from below and to conform to the contour of the body of an infant who is too young to be able to sit up without support with the infant's back in an erect position, the infant seat having bottom and back portions and having a vertical height measured from a lowest point of the bottom portion to a highest point of the back portion, the support structure having a height which enables the infant to be supported in the infant seat at a height substantially above floor level, said height of the support structure being greater than the vertical height of the infant seat, whereby the infant seat is supported at a height allowing the infant in the infant seat to be drawn up to a dining table at substantially dining table height for feeding;

a pair of pivots, each pivot coupled to a side of said infant seat, the pivots directly attaching said infant seat to the top portions of respective pairs of said legs, said pivots defining at least two positions of said infant seat, said positions including an upright position and a reclined position; and means for locking said infant seat in each of said positions.

20. The infant highchair of claim 19, wherein said pivots comprise two hubs, each hub enclosing means for rotating the infant seat with respect to the support structure.

21. The infant highchair of claim 20, wherein the locking means is provided in at least one of the hubs.

22. The infant highchair of claim 21, further comprising a locking means in each of said hubs.

23. The infant highchair of claim 20, wherein the hubs each include a recess receiving a respective top portion.

24. The infant highchair of claim 20, wherein a button of the locking means extends through an aperture in a hub, for operation by a user to unlock and lock the infant seat.

25. The infant highchair of claim 19, further comprising a wheel at the bottom of each of said legs.

26. The infant highchair of claim 25, wherein the wheel at the bottom of each of said legs comprises a caster.

27. The infant highchair of claim 19, further comprising horizontal bars near the bottom of said legs connecting pairs of said legs together.

28. The infant highchair of claim 27, further comprising a removable shelf resting on said horizontal bars.

29. The infant highchair of claim 28, wherein the shelf comprises an open grid structure.

30. The infant highchair of claim 19, further comprising a shelf disposed horizontally near the bottom of said legs.

31. The infant highchair of claim 30, wherein the shelf comprises an open grid structure.

32. The infant highchair of claim 19, further comprising a seat belt for securing an infant in the infant seat.

33. The infant highchair of claim 32, wherein the seat belt comprises a waist and crotch belt.

34. The infant highchair of claim 19, further comprising two horizontal bars connecting pairs of said legs and located below said infant seat for providing stops limiting forward and rearward pivotal motion of the infant seat.

35. The infant highchair of claim 19, wherein the infant seat comprises molded plastic.

36. The infant highchair of claim 35, further comprising padding for said molded infant seat.

37. The infant highchair of claim 19, further comprising a wheel at the bottom of at least two of said legs.

* * * * *